United States Patent [19]

Crouch et al.

[11] Patent Number: 4,817,951

[45] Date of Patent: Apr. 4, 1989

[54] PLAYER OPERABLE LOTTERY MACHINE HAVING DISPLAY MEANS DISPLAYING COMBINATIONS OF GAME RESULT INDICIA

[75] Inventors: Philip C. Crouch, Vaucluse; Patrick J. Finnigan, Monterey, both of Australia

[73] Assignee: Ainsworth Nominees Pty. Limited, New South Wales, Australia

[21] Appl. No.: 66,373

[22] Filed: Jun. 25, 1987

[30] Foreign Application Priority Data

Jun. 26, 1986 [AU] Australia ..... PH6587

[51] Int. Cl.[4] ..... A63B 71/04

[52] U.S. Cl. ..... 273/143 R; 273/138 A

[58] Field of Search ..... 273/1 E, 138 A, 143 R, 273/DIG. 28; 364/410–412; 902/23

[56] References Cited

U.S. PATENT DOCUMENTS 4,517,558 5/1985 Davids ..... 273/143 R 4,669,729 6/1987 Solitt et al. ..... 273/138 A 4,695,053 9/1987 Vazquez, Jr. et al. ..... 273/143 R

*Primary Examiner*—Maryann Lastova

*Attorney, Agent, or Firm*—Holman & Stern

[57] ABSTRACT

A lottery machine comprising a display which can display combinations of indicia selected from a predetermined set of such combinations, and a control device arranged to sequentially select game results from a predetermined set of game results and to display an indicia combination corresponding to the selected result on the display. Each game on the machine is initiated by a player and can only be initiated after the player has established a credit in the machine. At the commencement of operation of the machine, or when a previous set of game results have all been used, the control device sequentially selects each possible game result for the next series of games to be played and randomly allocates the results to game numbers in the series in order to produce a new set of predetermined game results.

8 Claims, 8 Drawing Sheets

Figure 1:
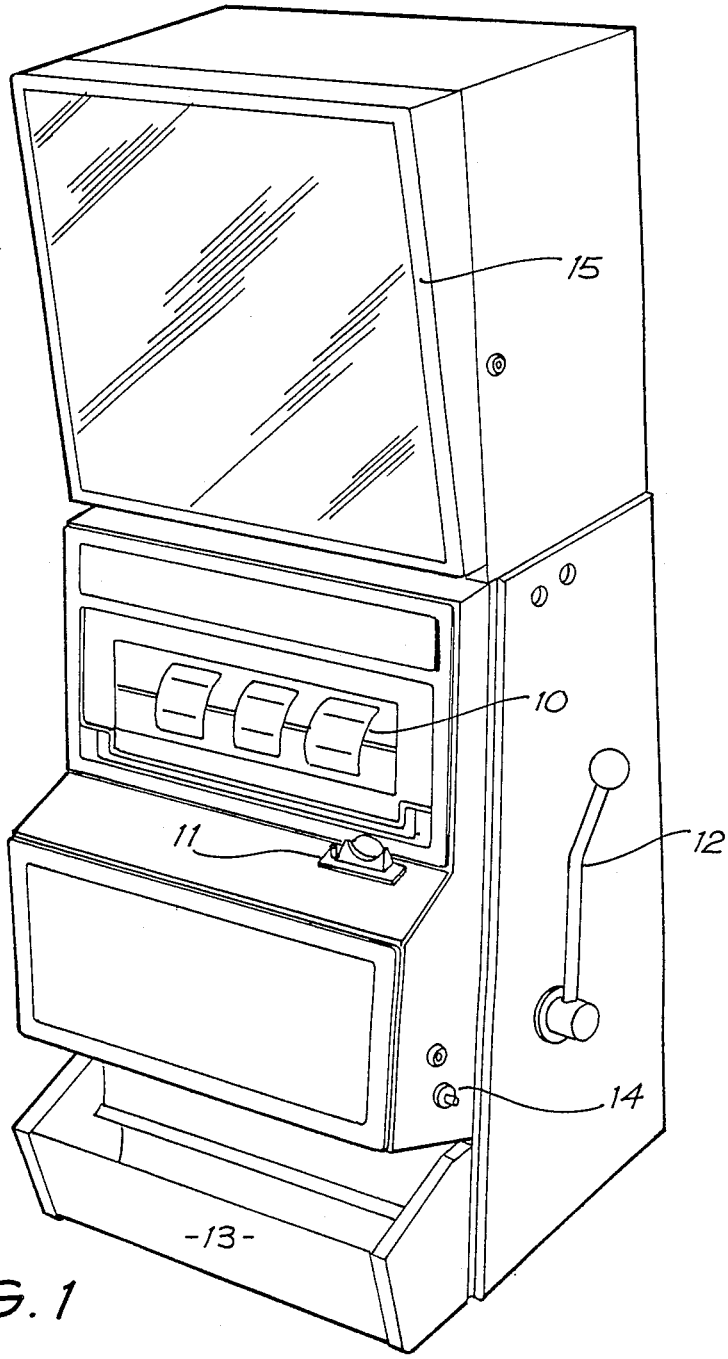

| "TICKET" No. | |
|---|---|
| 1 | - |
| 2 | - |
| 3 | ONE COIN |
| 4 | - |
| 5 | - |
| 6 | ONE COIN |
| 7 | - |
| 8 | - |
| 9 | - |
| 293 | - |
| 294 | - |
| 295 | - |
| 296 | - |
| 297 | - |
| 298 | - |
| 299 | - |
| 300 | ONE COIN |

PLAYER OPERABLE LOTTERY MACHINE HAVING DISPLAY MEANS DISPLAYING COMBINATIONS OF GAME RESULT INDICIA

The present invention relates to the running of instant lotteries and in particular the invention provides a lottery machine with which instant lotteries may be operated without the need to issue tickets.

Forms of lotteries known as instant lotteries are well known, wherein a set of tickets are produced, a predetermined portion of which are prize winning tickets. The set of tickets are then shuffled and sold to players, each of the tickets having a combination of indicia printed thereon in a manner which is hidden from the player when the ticket is purchased. The indicia are subsequently revealed to the player by scratching an upper surface from the ticket or tearing the ticket open. Such forms of lotteries are quite popular, however, while they enable small prizes to be paid immediately by the ticket seller, it is still necessary for the player to collect larger prizes from a central authority. Further, such lotteries still have a requirement that tickets be printed and distributed and winning tickets must be monitored in order to prevent any possibility of forgery.

The present invention consists in a player operable instant lottery machine, comprising display means, control means to control the operation of the display means and initiation means operable by a player to cause the control means to select and display a new result on the display means, said display means comprising means to simultaneously display several indicia in combination, said indicia being selected from a predetermined set of indicia and said combination being selected from a predetermined set of combinations of said indicia, the control means including storage means for storing an ordered set of game results representing all of the pseudo tickets of a lottery game series which is currently in progress, random number selection means for matching game results with game numbers in said ordered set of game results and storing the ordered set in the storage means at the commencement of a game series and means for selecting results from the ordered set in the order in which they are stored, in response to operation of the initiating means and displaying combinations corresponding to the respective results.

In preferred embodiments of the invention machines are provided with several game styles and after each game series of a particular style, the game style is changed and a new game series initiated in the new style, with different winning percentages.

Preferably, the machine includes means for inserting a payment, such as a coin slot and the initiating means comprises a button or handle operated switch similar to those in use in prior art poker machines. In the preferred embodiment winning combinations of said indicia are rewarded by payment of a cash prize, however, it will be recognised that other forms of reward may also be provided.

Figure 2:
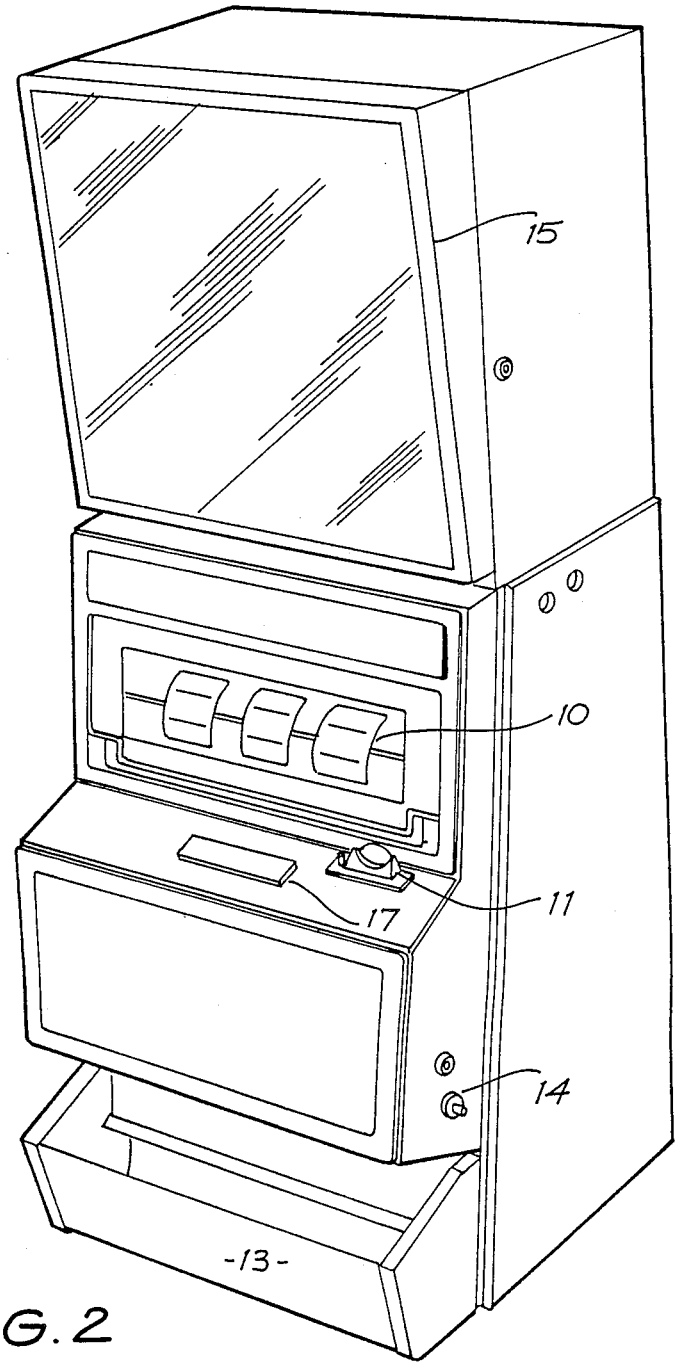
Figure 3:
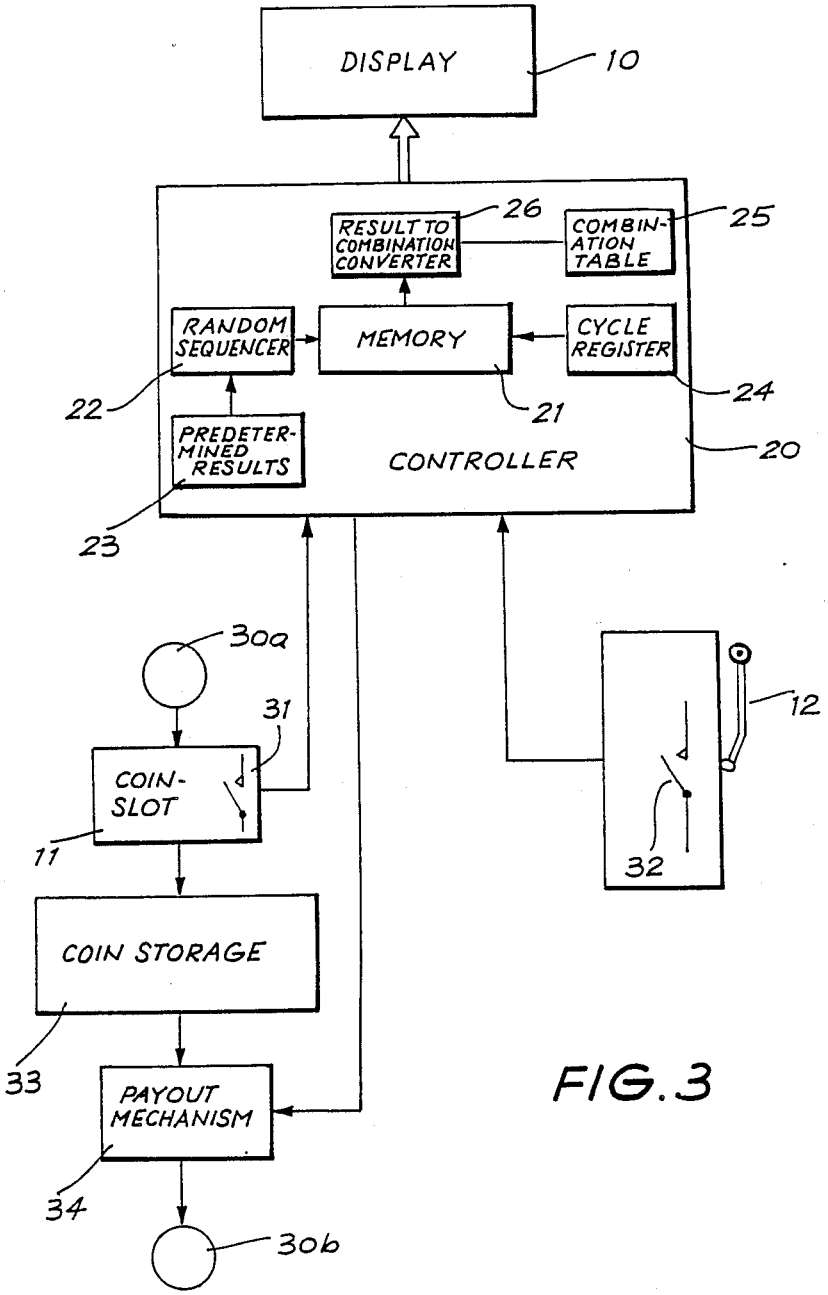
Figure 4:
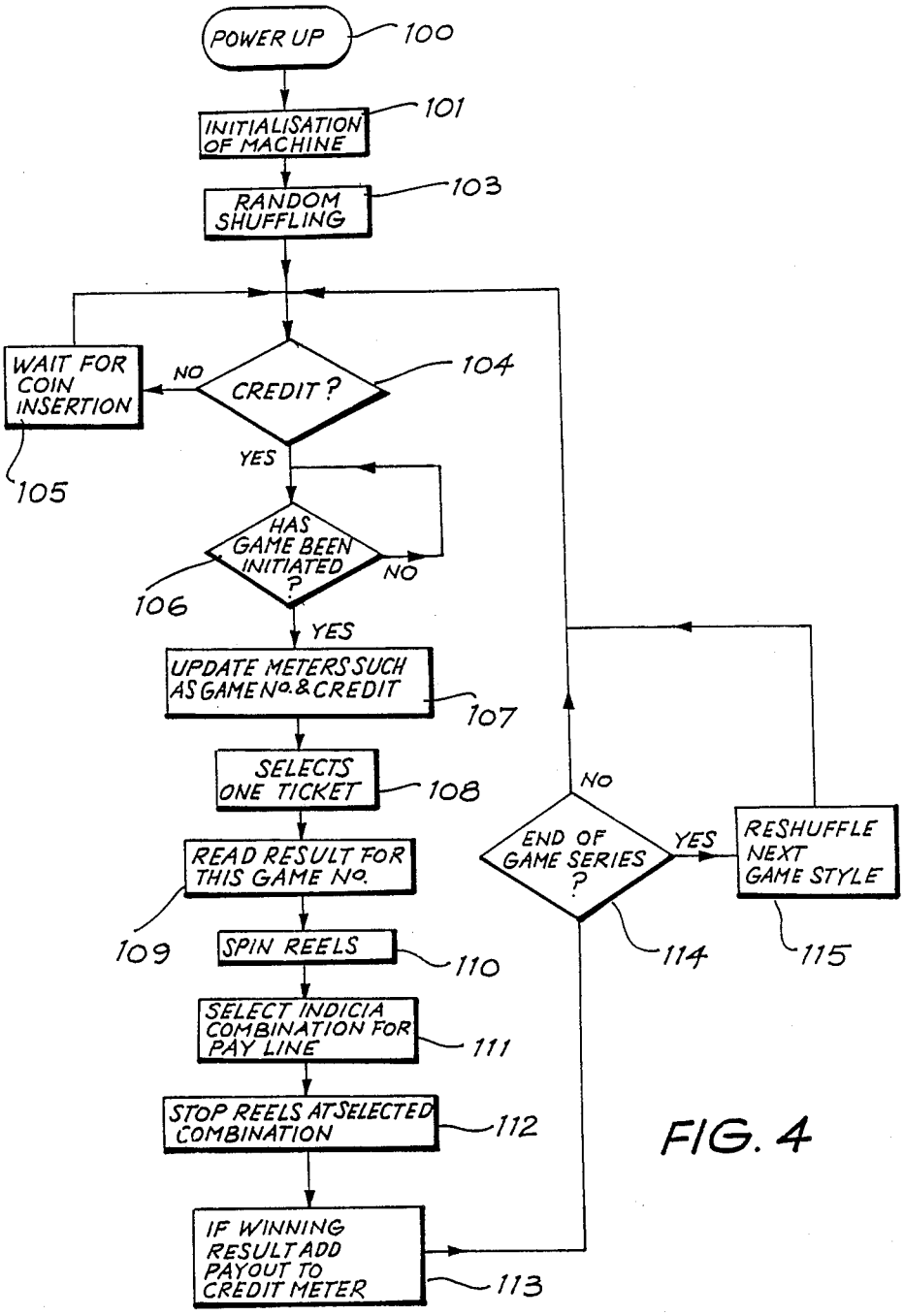
Figure 5:
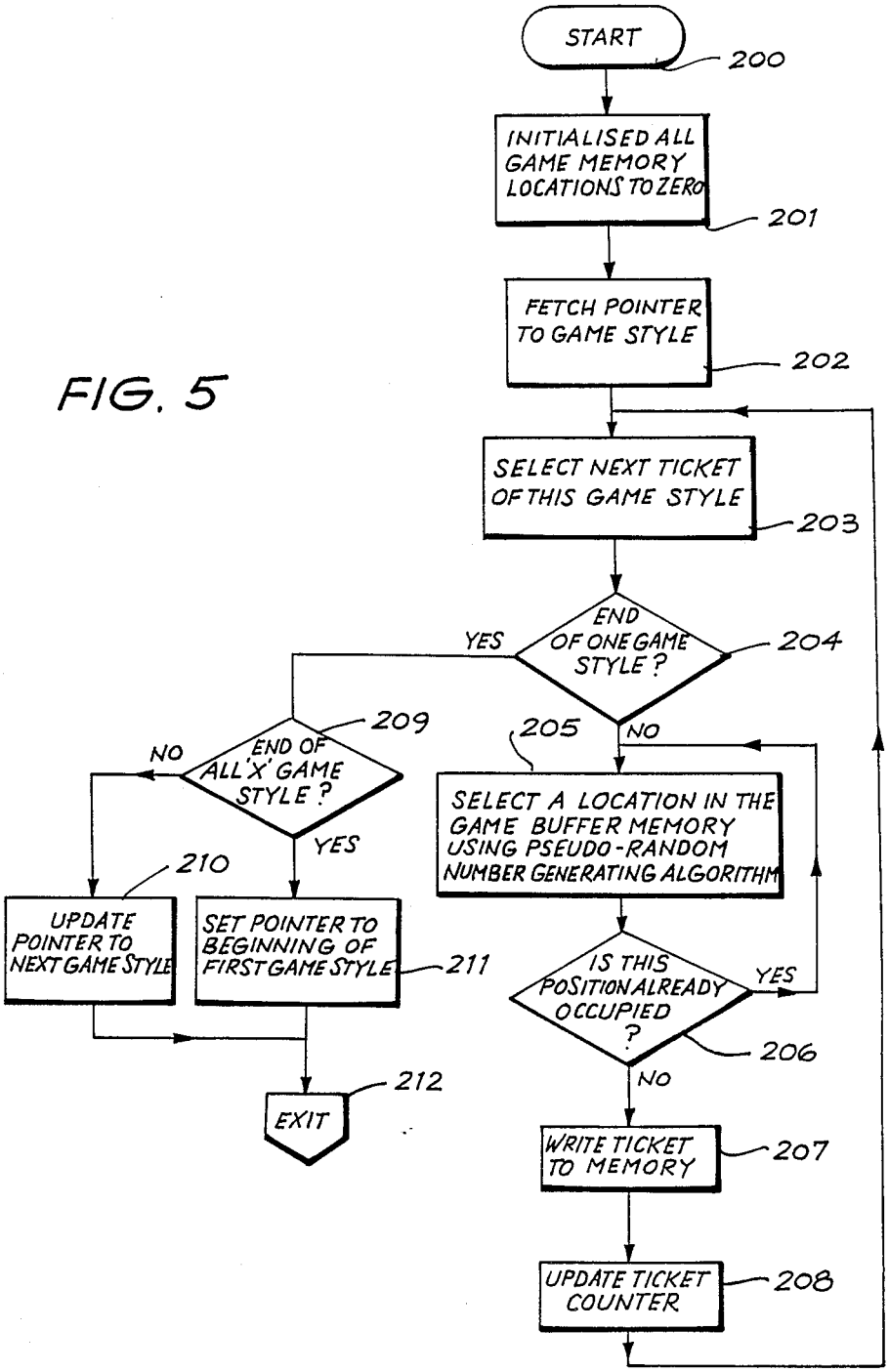
Figure 6:
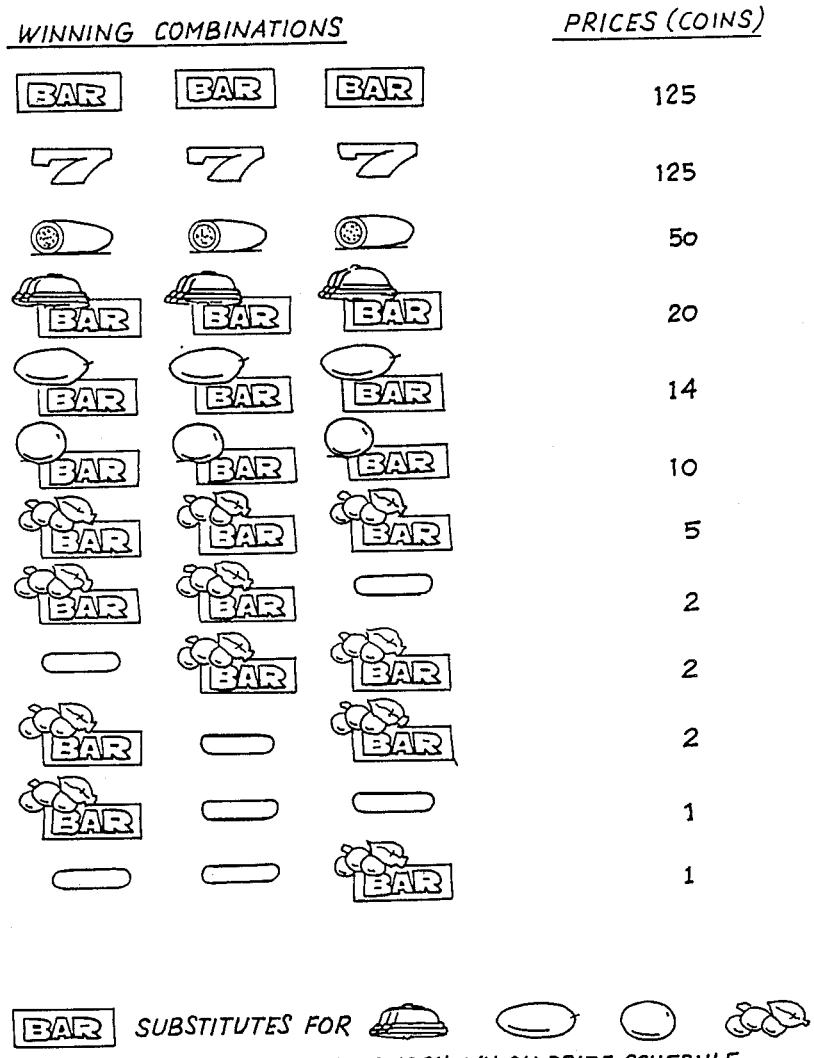
Figure 7:
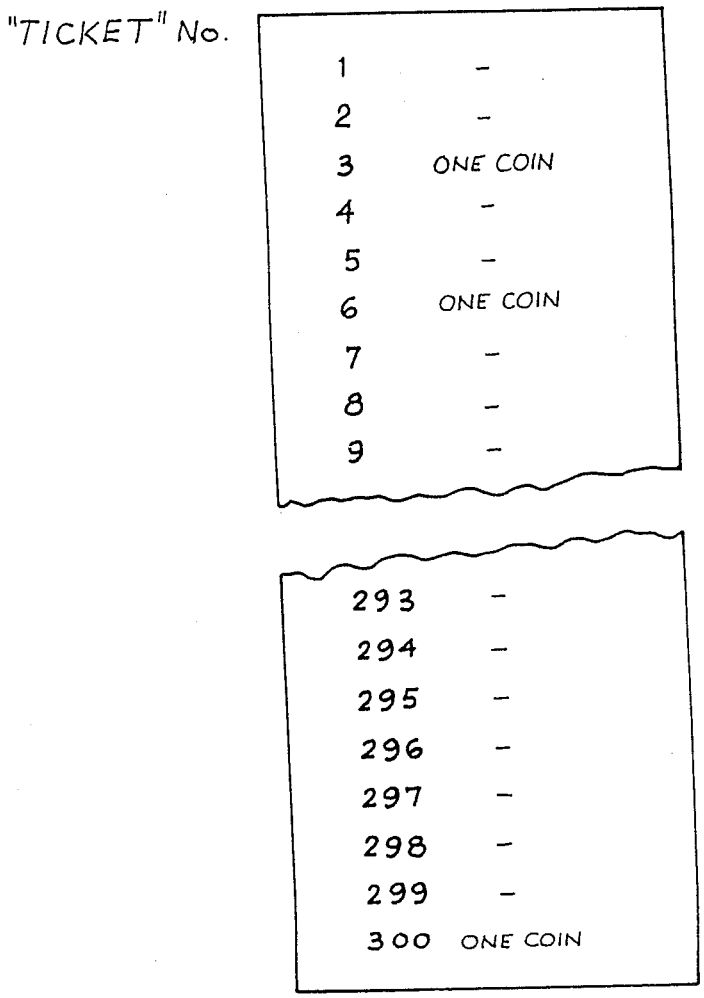
Figure 8:
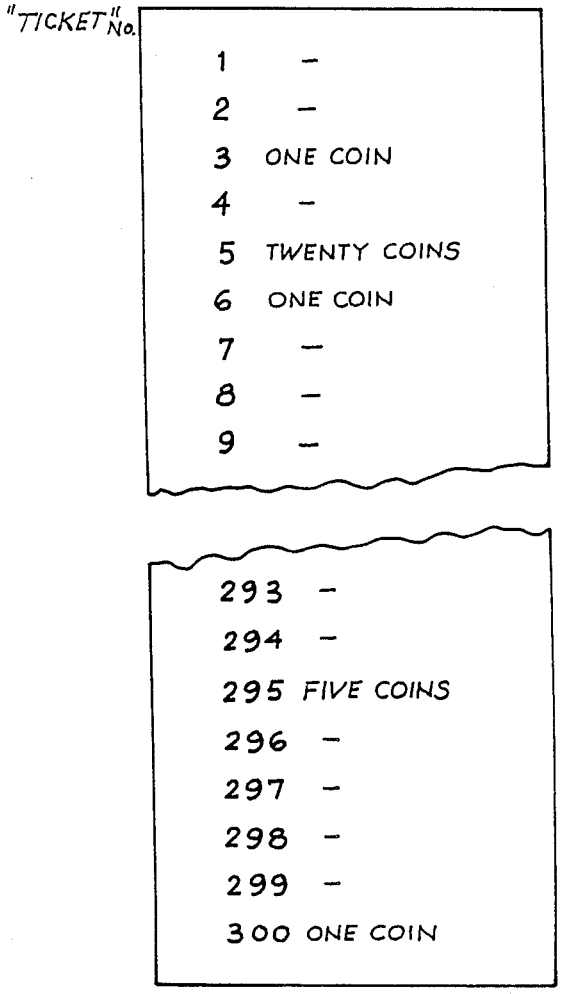

An embodiment of the invention will now be described, by way of example, with reference to the accompanying drawings, in which:

FIG. 1 and 2 illustate two possible arrangements for the outer casing of a lottery machine according to the present invention;

FIG. 3 schematically illustrates the operation of a machine in accordance with the invention; and FIGS. 4 and 5 illustrate flow charts describing the operation of the machine of FIG. 3;

FIG. 6 illustrates the prize schedule of winning combinations for a typical game played on a machine in accordance with the present invention; and FIGS. 7 and 8 illustrate two steps in the generation of a game results table which is generated at the beginning of a game series.

Referring now to FIGS. 1 and 2, lottery machine cabinets in accordance with the present invention are illustrated wherein the display means 10 comprises a plurality of reels, a portion of each of which is visible through a respective window, the reels carrying a plurality of indicia such that, when the reels are stopped one indicia from each reel is visible on the pay line in the respective window, thereby providing a combination of line indicia which indicate whether a prize has been won by the player.

A game cycle is initiated by the player by insertion of a coin or token into the coin slot 11 and the operation of the handle 12 of FIG. 1 or the play button 17 of FIG. 2 to cause the next game result to be selected from the ordered set of game results and to cause the reels of the display means 10 to rotate. When a game result has been selected, a combination of indicia representing that result is selected and the reels are caused to stop in positions which result in the selected indicia combination. If the new combination of indicia represents a prize winning combination a payout of coins or tokens is deposited into the tray 13 by the machine. Advice to the player regarding those combinations which are winning combinations would typically be displayed on the upper panel 15 of the machine and winning combinations may optionally be signalled by the alarm light and bell (not shown) located on top of the machine.

The basic operation of the lottery machine will now be described with reference to FIG. 3, which schematically illustrates a simplified form of the machine of FIG. 1. Operation of the machine is controlled by a controller 20 which includes the memory 21 adapted to hold a set of game results which are randomly determined at the beginning of a game series. The game results held in memory 21 are randomly ordered by a random sequencer 22 at the commencement of a new lottery game sequence, the random sequencer taking a predetermined set of results 23 and randomly allocating these to the games in a game series prior to writing them into the memory 21. The game results in memory 21 are then retrieved in the order that they are stored in the memory 21, once per game cycle with the cycle number being tracked by the cycle register 24. Typically there will be 300 games in a game series and when one series ends a new set of random results will be generated and the new game series commenced. In preferred embodiments successive game series will be of different game styles with differing payout ratios.

Once a game has been initiated and a game result has been retrieved for that game cycle, a combination table 25 is used to select a combination of indicia which correspond to that result and the reels are started spinning and stopped at the appropriate combination. In some instances several combinations of indicia might correspond to a given game result, in which case a combination will be selected which gives the appropriate length of spin of the reels.

In order to initiate a game cycle, the player first inserts a coin 30 into the coin slot 11 causing a coin acceptance switch 31 to signal the controller that a coin has been inserted. The controller then releases an interlock allowing operation of the handle 12 which operates a cycle initiation switch 32 to signal the controller to commence a new game cycle. The controller then selects the next game result from memory 21, selects a corresponding indicia combination from the table 25 and the result-to-combination converter 26 causes this combination to be displayed on display 10. Meanwhile, the coin 30*a* passes through the coin slot 11 and into the coin storage means 33. Once the display means has displayed the new combination, and if the combination is a winning combination, the controller signals the payout mechanism 34 to pay a predetermined number of coins 30*b* from the coin storage means 33. The machine is then in condition for the commencement of the next game cycle. Referring now to FIG. 4, the machine's operation is illustrated in flow chart form from which it will be seen that at commencement at the operation of the machine, initialization 101 occurs, and a new randomly ordered set of results is then generated and written to the memory 21 in the shuffling step 103. The procedure for results generation will be described in greater detail hereinafter, with reference to FIG. 5. The machine then tests for a credit 104 and waits for coin insertion 105 if no credit is established. When a credit is present the machine waits for player initiation 106 of a game cycle at which time various meters such as game number and credit meters are updated 107. The next pseudo-ticket or game No. 108 is selected and the respective result is then selected 109 from memory 21 and the reels on display 10 are spun 110. After commencing spinning of the reels; conversion of the result to a pay line combination is performed by selecting a pay line combination 11 from the combination table 25 and the reels are then stopped 112 with the selected combination showing on the pay line. If the result was a winning result, the payout is then added to the credit meter 113.

At the end of each game, the game counter is tested 114 to determine if the completed game was the last game of a game series, and if so a new game style is selected and a new set of random results is generated 115 for the next game series. The number of winning combinations in the new game series will be determined in accordance with the new game style. In the preferred embodiment 4–6 game styles are provided, each having different combinations of payout sizes, and the machine cycles through all of the game styles before returning to the first. Once a new game series has been generated 115, or if the previous series is not yet completed, the machine tests the credit meter 104 at commencement of a new game cycle and the process described above is repeated.

When a game series is completed, a new set of game results is generated and written to memory 21 using the procedure illustrated in FIG. 5. This procedure is called at steps 103 and 115 of the procedure illustrated in FIG. 4. Having established that a new game is to be generated, all locations in memory 21 are initially set to zero 201 and a pointer to the next game style is fetched 202. This pointer points to a table of all of the game results or pseudo-tickets for the new game style. Starting with the first pseudo-ticket, the next pseudo-ticket of the game style is selected 203 until all of the tickets for this style of game have been shuffled. Each result of pseudo-ticket is then assigned to a randomly selected location in the game memory 21 using a pseudo-random number generating algorithm 205 and the selected location is tested 208 to determine if a result has already been written to it. If no result has been written to the selected location, the present result is written to it 207 and the ticket counter is updated. Otherwise a new location is randomly selected 105 and tested 106. When the result has been written 207 and the ticket number updated 208, the next result is selected 203 and the same sequence followed until all pseudo-tickets of the game style have been assigned and written to unique memory locations in memory 21.

When all of the pseudo-tickets have been written to memory 21 the style pointer is tested 209 to see if it is pointing to the last style and if so the pointer is reset 211 to point to the first style. Otherwise it is updated 210 to point to the next style. The shuffle procedure then terminates and control of the machine reverts to the procedure which initiated the shuffle.

Preferably, the display means 10 comprises a plurality of reels driven by stepping motors which step the reels from the currently displayed indicia to the next indicia to be displayed, dictated by the combination selected from table 25 in response to the result selected from memory 21. However, it will be recognised that the display could equally include a video screen which was controlled to display the appropriate indicia.

Whilst each lottery game series is played individually, winning combinations in each game style will represent the same payout. For example, the combination (BELL BELL BELL) in game style 1 might pay twenty coins and the combination (BELL BELL BELL) in game style 3 will also pay twenty coins, such that there is no need to state the combinations more than once on a score card associated with the machine. However the probability of achieving a particular combination will vary from game style to game style.

The following five tables illustrate typical lottery game styles and the result distribution relevant to these, while FIG. 6 illustrates the pay line combinations relevant to each payout size for each of the game styles. Each of the five lottery game styles shown consist of 300 pseudo-tickets and each pseudo-ticket would typically be purchased for twenty cents while the prize total for each lottery game style would not exceed $50.00.

TABLE 1

LOTTERY STYLE 1

| PRIZE DISTRIBUTION | COINS | PERCENTAGE OF EACH PRIZE |
|---|---|---|
| 25 × 1 COIN PAY = | 25 | 8.33 |
| 14 × 2 COIN PAY = | 28 | 9.33 |
| 5 × 5 COIN PAY = | 25 | 8.33 |
| 3 × 10 COIN PAY = | 30 | 10.00 |
| 3 × 14 COIN PAY = | 42 | 14.00 |
| 2 × 20 COIN PAY = | 40 | 13.33 |
| 1 × 50 COIN PAY = | 50 | 16.67 |
| 53 | 240 | 80% |

RETURN IS $\frac{240}{300} \times \frac{100}{1}$ = 80% TO PLAYER $\frac{300}{53}$ = 1/5.66 HIT RATE AVERAGE

TABLE 2

LOTTERY STYLE 2

| PRIZE DISTRIBUTION | COINS | PERCENTAGE OF EACH PRIZE |
|---|---|---|
| 16 × 1 COIN PAY = | 16 | 5.33 |
| 15 × 2 COIN PAY = | 30 | 10.00 |
| 5 × 5 COIN PAY = | 25 | 8.33 |
| 1 × 10 COIN PAY = | 10 | 3.33 |
| 1 × 14 COIN PAY = | 14 | 4.67 |
| 1 × 20 COIN PAY = | 20 | 6.67 |

TABLE 2-continued

LOTTERY STYLE 2

| PRIZE DISTRIBUTION | COINS | PERCENTAGE OF EACH PRIZE |
|---|---|---|
| 1 × 125 COIN PAY = | 125 | 41.67 |
| 40 | 240 | 80% |
| RETURN IS $\frac{240}{300} \times \frac{100}{1}$ | 80% TO PLAYER | |
| $\frac{300}{40}$ | 1/7.50 HIT RATE AVERAGE | |

TABLE 3

LOTTERY STYLE 3

| PRIZE DISTRIBUTION | COINS | PERCENTAGE OF EACH PRIZE |
|---|---|---|
| 17 × 1 COIN PAY = | 17 | 5.67 |
| 30 × 2 COIN PAY = | 60 | 20.00 |
| 7 × 5 COIN PAY = | 35 | 11.67 |
| 1 × 10 COIN PAY = | 10 | 3.33 |
| 2 × 14 COIN PAY = | 28 | 9.93 |
| 2 × 20 COIN PAY = | 40 | 13.33 |
| 1 × 50 COIN PAY = | 50 | 16.67 |
| 60 102 | 240 | 80% |
| $\frac{240}{300} \times \frac{100}{1}$ | = 80% TO PLAYER | |
| $\frac{300}{60}$ | = 1/5.0 HIT RATE AVERAGE | |

TABLE 4

LOTTERY STYLE 4

| PRIZE DISTRIBUTION | COINS | PERCENTAGE OF EACH PRIZE |
|---|---|---|
| 20 × 1 COIN PAY = | 20 | 6.67 |
| 13 × 2 COIN PAY = | 26 | 8.67 |
| 3 × 5 COIN PAY = | 15 | 5.00 |
| 2 × 10 COIN PAY = | 20 | 6.67 |
| 1 × 14 COIN PAY = | 14 | 4.67 |
| 1 × 20 COIN PAY = | 20 | 6.67 |
| 1 × 125 COIN PAY = | 125 | 41.67 |
| 41 177 | 240 | 80% |
| RETURN IS $\frac{240}{300} \times \frac{100}{1}$ | = 80% TO PLAYER | |
| $\frac{300}{41}$ | = 1/7.3 HIT RATE AVERAGE | |

TABLE 5

LOTTERY STYLE 5

| PRIZE DISTRIBUTION | COINS | PERCENTAGE OF EACH PRIZE |
|---|---|---|
| 20 × 1 COIN PAY = | 20 | 6.67 |
| 16 × 2 COIN PAY = | 32 | 10.66 |
| 4 × 5 COIN PAY = | 20 | 6.67 |
| 2 × 10 COIN PAY = | 20 | 6.67 |
| 2 × 14 COIN PAY = | 28 | 9.33 |
| 1 × 20 COIN PAY = | 20 | 6.67 |
| 2 × 50 COIN PAY = | 100 | 33.33 |
| 47 102 | 240 | 80% |

TABLE 5-continued

LOTTERY STYLE 5

| PRIZE DISTRIBUTION | COINS | PERCENTAGE OF EACH PRIZE |
|---|---|---|
| RETURN IS $\frac{240}{300} \times \frac{100}{1}$ | = 80% TO PLAYER | |
| $\frac{300}{47}$ | = 1/6.38 HIT RATE AVERAGE | |

We claim:

1. A player operable instant lottery machine, comprising display means, control means to control the operation of the display means, and initiation means operable by a player to cause the control means to select and display a new result on the display means, said display means comprising means to simultaneously display several indicia in combination, said indicia being selected from a predetermined set of indicia and said combination being selected from a predetermined set of combinations of said indicia, the control means including storage means for storing an ordered set of numbered game results representing a set of pseudo tickets of a lottery game series which is currently in progress, random number selection means for generating game results for said ordered set of game results and means for storing the ordered set in the storage means at the commencement of each said game series, means for sequentially selecting a next game result from the ordered set in the order in which they are stored in response to operation of the initiating means and means for displaying a combination of indicia corresponding to the currently selected game result.

2. The lottery machine of claim 1 wherein a plurality of styles of lottery game are provided by said control means, each style having a different set of results, and a new style being selected each time a set of game results is selected at the commencement of each of said game series.

3. The lottery machine of claim 2 wherein the games are selected in sequence by said control means and when each of the plurality of styles has been used, the first style is repeated.

4. The lottery machine of claim 1 wherein the display means comprises a plurality of rotatable reels each carrying a plurality of indicia from said set of indicia and means to rotate the reels and stop them at selected indicia.

5. The lottery machine of claim 4 wherein the reels are free spinning and are stopped spinning by engaging a pawl into a toothed wheel.

6. The lottery machine of claim 4 wherein the reels are driven by an electric motor and are stopped by braking the electric motor.

7. The lottery machine of claim 6 wherein the electric motor is a stepping motor.

8. The lottery machine of claim 1 wherein the display means comprises a video screen and video screen controlling circuit adapted to generate images on the screen representative of a plurality of rotatable reels, such that the display is made to simulate a plurality of spinning reels when a game is initiated, which simulated reels when stopped indicate the indicia combination representing the game result.

* * * * *